US005683169A

United States Patent [19]

Lucas et al.

[11] Patent Number: 5,683,169

[45] Date of Patent: Nov. 4, 1997

[54] FLUORESCENT-LIGHTED FOUR POST BED

[76] Inventors: Donald R. Lucas, 1205 Wayside Dr., Villa Park, Ill. 60181; Ronald W. Allen, 532 Cherbourg Ct. S., Buffalo Grove, Ill. 60089

[21] Appl. No.: 631,975

[22] Filed: Apr. 15, 1996

[51] Int. Cl.[6] ..... A47B 97/00; F21V 33/00

[52] U.S. Cl. ..... 362/130; 362/801; 5/905

[58] Field of Search ..... 362/217, 221, 362/222, 223, 225, 130, 801, 127, 260, 410, 411, 431; 5/905, 281, 658

[56] References Cited

U.S. PATENT DOCUMENTS

| | | | |
|---|---|---|---|
| 819,068 | 5/1906 | Ives . | |
| 1,298,362 | 3/1919 | Lewry | 362/130 |
| 1,568,930 | 1/1926 | Symmes et al. . | |
| 1,904,121 | 4/1933 | Stetner . | |
| 1,991,111 | 2/1935 | Murrell | 362/130 |
| 2,290,866 | 7/1942 | Cunard . | |
| 2,418,877 | 4/1947 | Gustafson . | |
| 2,744,186 | 5/1956 | Kamin . | |
| 4,742,437 | 5/1988 | Downey | 362/130 |
| 4,947,298 | 8/1990 | Stephen | 362/130 |

*Primary Examiner*—Thomas M. Sember

[57] ABSTRACT

An improved bed-lighting mechanism having a headboard (10) and footboard (11) attached perpendicular to left (12) and right (13) side rails which have left (20) and right (21) cable guards attached beneath and parallel to them, respectively. Four-foot (14A and 14B) and six-foot (17A and 17B) bedposts sandwich four-foot (15) and six-foot (18) fluorescent-light tubes and are attached perpendicular to the corner joint formed by the headboard (10) and footboard (11) to the left (12) and right (13) side rails. End caps (16 and 19) sit atop and below the bedposts (14A, 14B, 17A, and 17B). The fluorescent-light tubes (15 and 18) are encased by protective plastic sheaths (54). A ballast and switch box (55) houses a ballast (25) that powers the two, four-foot fluorescent-light tubes (15) and a ballast (26) that powers the two, six-foot fluorescent-light tubes (18). The ballast and switch box (55) has a power cord (29) and a power/dimmer switch (30) running into it and wiring (31 and 32) threaded through conduit pipe (28) running out of it to power and control the fluorescent-light tubes (15 and 18).

5 Claims, 4 Drawing Sheets

54
53
14A
14B
15
51
51
42
50
39
52
41
37
49
37
49
47
38
46
48
39
49
43
44
45
40
43
52
16

FIG. 5B
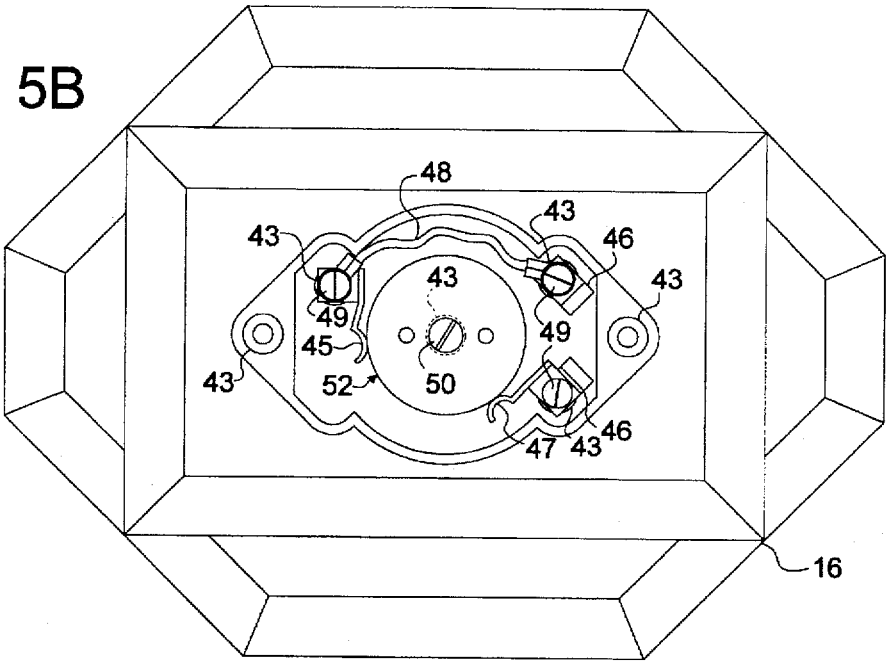
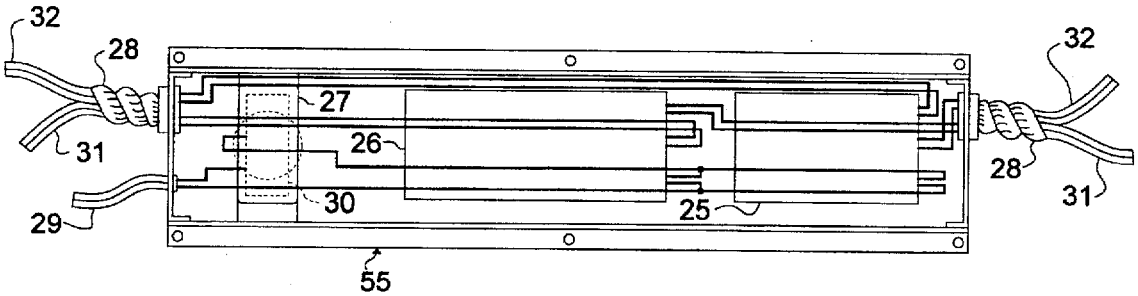
FIG. 6

FLUORESCENT-LIGHTED FOUR POST BED

BACKGROUND

1. Field of Invention

This invention relates to beds, specifically to an improved bed-lighting mechanism that significantly improves upon the efficiency, reliability, longevity, and overall usable illumination of all previous bed-lighting mechanisms.

2. Discussion of Prior Art

Ever since electric lighting was made available to the public, people have been developing it to be put on beds to use for reading or other bed-related activities needing illumination.

Lighting comes in two forms for beds: One form has lamps attached to the bed, whereas the other form integrates the lighting into the bed itself. Most of the bed lighting found in the previous art is esthetically awkward, and all are functionally cumbersome.

Most bed lighting is esthetically awkward because it visually appears exactly as it is made, as an afterthought. This type of bed lighting fails to preserve the natural structural integrity of the beds it is placed upon and further it does not harmonize with the bed on which it is mounted because it is made simply as an accessory, not as a necessity. All bed lighting is functionally cumbersome on several accounts with the most prominent being that it does not obtain its main objective: None of the lighting for beds in the previous art shed light without casting shadows on the occupant(s) in the bed and/or on the occupant's work nearby (e.g., a book or other reading material). This most prominent functional problem results from some combination of the location (only one and/or inappropriate) and the source (incandescent lamps) of the bed lighting. In addition to the above described disadvantages, other functional problems (e.g., inefficient, unreliable, and non-proficient) with the bed lighting found in the previous art will become apparent following a reading of the specification.

The lighting for a bed in U.S. Pat. No. 819,068 to Ives, 1906 May 1, put incandescent lamps within the knobs atop the posts of a four-post bed. Although Ives' invention was innovative for his time, today this type of lighting configuration fails to shed light efficiently and usefully. The incandescent lamps burn out at a rate of about one every one-thousand hours and because of their locations cast intrusive shadows along with their light.

The lighting for a bed in U.S. Pat. No. 1,298,362 to Lewry, 1919 Mar. 25, put incandescent lamps within small cutouts of the posts of a four-post bed. Lewry's lighting configuration fails to shed light efficiently and usefully. The incandescent lamps together with their specific locations within the bedposts cast intrusive shadows with only a limited amount of light for the bed's occupants.

The lighting for a bed in U.S. Pat. No. 1,568,930 to Symmes and Hanschen, 1926 May 11, was an incandescent lamp that attached to the bed's headboard. This invention fails to integrate itself into the structure of the bed and is functionally inadequate because of its single location placement and use of an incandescent lamp.

The lighting for a bed in U.S. Pat. No. 1,904,121 to Stetner, 1933 Apr. 18, was a lamp shade for a single bed lamp over the headboard of the bed (see Symmes and Hanschen, 1926). Although this invention directs the incandescent lighting on a bed in a more adaptive manner than before, it still casts interfering shadows and is not integrated with the bed itself.

The lighting for a bed in U.S. Pat. No. 1,991,111 to Murrell, 1935 Feb. 12, put an incandescent lamp within the bed's headboard. Although this invention is more integrated than Symmes and Hanschen's (1926) similar invention, it still fails to be structurally part of the bed and is functionally inadequate because of its single location placement and use of an incandescent lamp.

The lighting for a bed in U.S. Pat. No. 2,290,866 to Cunard, 1940 Jan. 11, was an incandescent lamp that attached underneath the bed. This invention is functionally inadequate because of its single location placement and use of an incandescent lamp.

The lighting for a bed in U.S. Pat. No. 2,418,877 to Gustafson, 1947 Apr. 15, was an incandescent lamp with shade that attached to the bed's headboard. This invention integrated Symmes and Hanschen, and Stetner's inventions to form a new lighting system for beds that does not disturb others in the room. Because of the single light source location and usage of incandescent lamps this invention still has the functional problems discussed above. Further, the appearance of the bed lamps lacks the synergy needed to be esthetically pleasing.

The lighting for a bed in U.S. Pat. No. 2,744,186 to Kamin, 1956 May 1, was incandescent lamps attached to the tops of bed posts. Although Kamin's invention is more transportable than Ives' invention, it still has the functional problems of casting shadows on the bed's occupants. Further, the efficiency of the incandescent lamps continues to be a significant problem (see Ives; 1906).

The lighting for a bed in U.S. Pat. No. 4,742,437 to Downey, 1988 May 3, was a series of incandescent lamps connected to the mattress box of a water bed. Downey's invention fails any of the functional standards for the lighting to be used by the occupant(s) of the bed because of the light's location and because of the usage of incandescent light bulbs.

The lighting for a bed in U.S. Pat. No. 4,947,298 to Stephen, 1990 Aug. 7, was a series of incandescent light bulbs connected to the side rails of a bed powered by a mechanism initiated by pressure from the mattress. This invention too fails all of the functional standards for the lighting to be used by the occupant(s) of the bed because of the location of the lights and because of the usage of incandescent light bulbs.

SUMMARY OF THE INVENTION

The present invention continues the development of bed lighting by implementing a novel design and materials to solve some of the oldest problems of bed lighting. Our fluorescent-lighted four post bed is a novel solution to the esthetic and functional problems of bed lighting. Our solution comes way by a novel configuration of unconventional bed-making materials. Instead of the conventional bed-making materials of wood, metal, and plastic being primarily utilized, our bed's primary component is fluorescent-light tubes. As the discussion of the prior art revealed, many beds have lights as secondary accessories (e.g., reading lights or track lighting), however none of them have made the next step to involve light as a primary component. Our invention has made this step. Our bed has a classic four-post design with the novelty of the posts being shafts of light.

Neither the fluorescent-light tubes by themselves, nor their location by itself, comprise our invention, instead, the essence of our invention is the unique combination of these two basic components into the formation of an efficient, reliable, longevous, and overall better usable bed-lighting mechanism. Accordingly, several objects and advantages of our invention result:

(1) It is an advantage of the present invention that the longevity of the fluorescent lights comprising our bed is 20 times that of the incandescent lights found within previous bed lighting. The average life of our lighting is 20,000 hours (2.25 years continuous) while that of previous bed lighting is about 1000 hours (41 days).

(2) A further advantage of the present invention is that the efficiency of the fluorescent lights comprising our bed is 3.5 times as much light per watt than the incandescent lights found within previous bed lighting.

(3) A further advantage of the present invention is that the location and source of lighting (fluorescent) comprising our bed supplies a nearly shadowless blanket of light for the bed's occupants without the intrusive shadows yielded from the location and source (incandescent) of lights comprising previous beds.

(4) Another advantage of the present invention is that other lights are no longer needed in the bedroom because of the brilliant light of the fluorescent light emanating from our invention. Reading lights, table lamps, floor lamps all become unnecessary (i.e., not needed to be purchased) with the addition of our bed into the bedroom.

(5) Yet another advantage of the present invention is to provide an esthetically pleasing bed structure resulting from the synergistic integration of fluorescent light within the bed posts without ever noticing the unsightly electronics hardware and light bulbs that can be found in previous bed lighting.

Other objects and advantages of our invention are:

(1) The present invention creates different moods for the bed's occupants by shining in either of two basic hues. Clear sheaths around the tubes allow the white color of fluorescence to be naturally relaxing and cool to the eyes. However, if one's appeal is for the feel of incandescent lighting, we also equip the tubes with golden-colored translucent sheaths for the radiance of warmth.

(2) Another object of the present invention is to provide chromatic color effects for the bed's younger clientele by putting one or multiple color sheaths over the fluorescent-light tubes.

(3) Another object of the present invention is to provide a dimmer switch upon the bed so the amount of illumination can be readily changed.

(4) Another object of the present invention is to provide the aforementioned bed with an easy-access control switch at the bottom of the back of the headboard so that it may be operated simply by the foot.

(5) Another object of the present invention is to provide the bed's occupant(s) with a completely novel visual experience: The contrast of light (fluorescent) against dark (bed post) creates a visual illusion caused by the eye recording only the most biologically significant information at any one time. Thus when looking at the posts, the eye records only the brightness of the fluorescent light while not recording the darkness of the light guides. One sees only four shafts of light.

(6) Another object of the present invention is the provision of an improved mechanism of the character of bed lighting that which employs rugged and simple construction that may be readily manufactured in many ornamental designs.

(7) Another object of the present invention resides in its use of a minimum of unique parts (~35) which leads to ease and efficiency of manufacturing and marketing.

(8) Another object of the present invention is to provide a novel, improved and unique bed-lighting mechanism that is of low cost to manufacture with respect to its materials and labor, which accordingly is then susceptible of the lowest possible prices of sale to the consuming public, thereby making such bed-lighting mechanism economically available to the buying public.

Other objects and advantages of the present invention reside in the novel construction and combination of parts to be hereinafter described and particularly pointed out in the claim, the nature of which will be readily apparent to those skilled in the art by reference to the accompanying drawings and descriptions.

BRIEF DESCRIPTION OF DRAWINGS

In the drawings, closely related figures have the same number but different alphabetic suffixes.

FIG. 5B is a top view of the four-foot end cap.

FIG. 6 is a schematic of some of the basic electronics of our invention, the ballast and switch box and its inner workings.

DESCRIPTION OF THE PREFERRED EMBODIMENTS

Figures 1A, 1B:
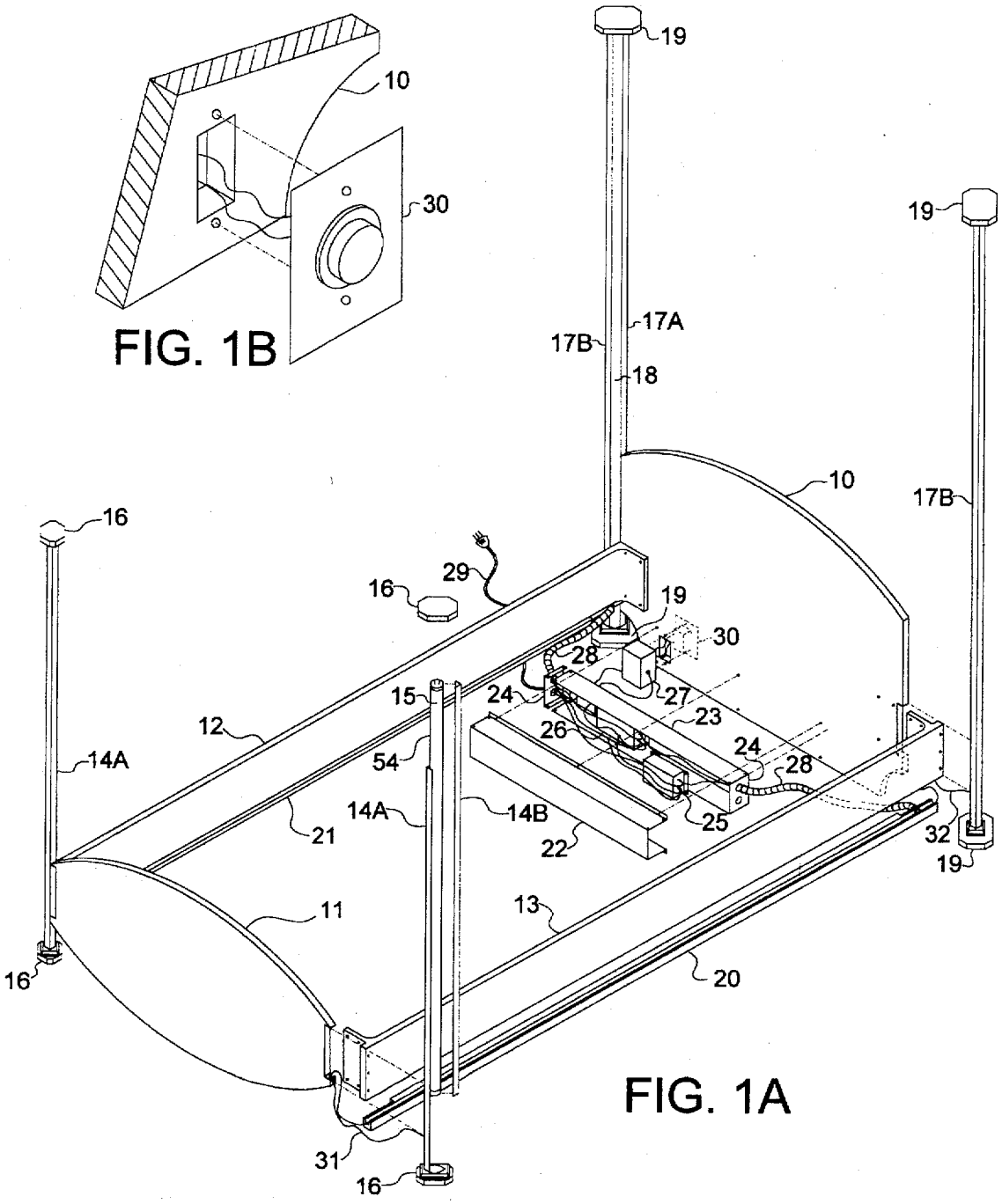
FIG. 1A is an overview of our invention, the fluorescent-lighted four post bed.
FIG. 1B is a back view of the headboard, showing the power/dimmer switch's connection to the headboard.

| Reference Numerals in Drawings | |
|---|---|
| 10 | headboard |
| 11 | footboard |
| 12 | left side rail |
| 13 | right side rail |
| 14A | four-foot inside bedpost |
| 14B | four-foot outside bedpost |
| 15 | four-foot fluorescent-light tube |
| 16 | four-foot end cap |
| 17A | six-foot inside bedpost |
| 17B | six-foot outside bedpost |
| 18 | six-foot fluorescent-light tube |
| 19 | six-foot end cap |
| 20 | right cable guard |
| 21 | left cable guard |
| 22 | top of ballast and switch box |
| 23 | back of ballast and switch box |
| 24 | side of ballast and switch box |
| 25 | four-foot ballast |
| 26 | six-foot ballast |
| 27 | power/dimmer switch box |
| 28 | conduit pipe |
| 29 | power cord |
| 30 | power/dimmer switch |
| 31 | four-foot wire lead |
| 32 | six-foot wire lead |
| 33 | bedpost top: crest |
| 34 | bedpost top: pin |
| 35 | bedpost top: screw |
| 36 | bedpost top: nuts |
| 37 | crown assembly: lower ring |
| 38 | crown assembly: spacer/insulator |
| 39 | crown assembly: upper ring |

-continued

| Reference Numerals in Drawings | |
|---|---|
| 40 | crown assembly: hub |
| 41 | crown assembly: hub cap |
| 42 | end cap: plate |
| 43 | knurled screw insert |
| 44 | end cap: post |
| 45 | lower crown assembly contact |
| 46 | bedpost-top contact |
| 47 | upper crown assembly contact |
| 48 | end cap: wire |
| 49 | end cap: screw |
| 50 | crown assembly: screw |
| 51 | end-cap-plate screw |
| 52 | crown assembly |
| 53 | bedpost-top assembly |
| 54 | plastic sheath |
| 55 | ballast and switch box |

FIG. 1A shows an overview of our invention, the fluorescent-lighted four post bed. The main structure of the bed is comprised of six basic elements: (1) two elliptically shaped, flat members of material that serve as a headboard 10 and a footboard 11, (2) two elongated horizontal, flat members of material that serve as left 12 and right 13 side rails, (3) four sets of two elongated, opposing vertical holders of material that serve as four-foot 14A and 14B and six-foot 17A and 17B bedposts, (4) one pair of four-foot 15 and one pair of six-foot 18 fluorescent-light tubes, (5) eight milled, flat members of material that serve as four-foot 16 and six-foot 19 bedpost, end caps, and (6) two elongated horizontal, flat members of material that serve as right 20 and left 21 cable guards. Each of these elements with the exception of the fluorescent-light tubes 15 and 18 is preferably made of hardwood, anodized aluminum, or stone. The fluorescent-light tubes 15 and 18 may be white or a specific color depending on the hue of the protective plastic sheaths 54 covering them.

FIG. 1A shows the interconnections of the bed's six basic elements: The headboard 10 and footboard 11 are attached perpendicular to the left 11 and right 13 side rails which have the right 20 and left 21 cable guards attached beneath and parallel to them, respectively. The four-foot 14A and 14B and six-foot 17A and 17B bedposts sandwich the four-foot 15 and six-foot 18 fluorescent-light tubes and are attached perpendicular to the corner formed by the joining of the headboard 10 and footboard 11 to the left 11 and right 13 side rails. The end caps 16 and 19 sit atop and below the bedposts 14A, 14B, 17A, and 17B. The fluorescent-light tubes 15 and 18 are encased by the protective plastic sheaths 54.

FIG. 1A and FIG. 1B show some of the basic electronics of the fluorescent-lighted four post bed. An exploded ballast and switch box: top 22, back 23, and side 24 can be seen in FIG. 1A. The ballast and switch box 22, 23, and 24 houses: (a) a ballast 25 that powers the two, four-foot fluorescent-light tubes 15, (b) a ballast 16 that powers the two, six-foot fluorescent-light tubes 18, and (a) a power/dimmer switch box 27. The ballast and switch box 22, 23, and 24 has a power cord 29 and a power/dimmer switch 30 running into it and wiring 31 and 32 through conduit pipe 28 running out of it to power and control the fluorescent-light tubes 15 and 18.

Figure 2:
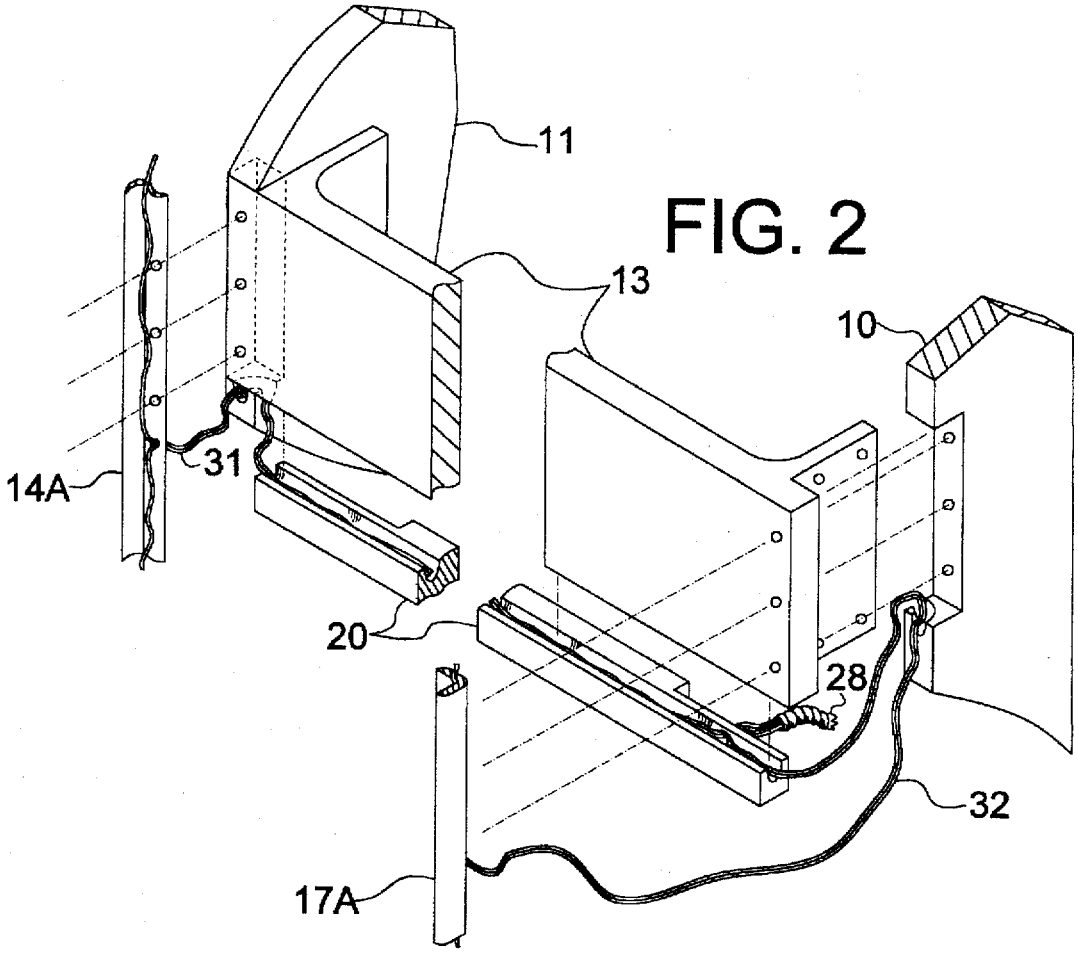
FIG. 2 is an exploded view of the corner joints of the headboard and footboard with the right side rail.

FIG. 2 is an exploded view of the corner joint between the headboard 10 or footboard 11 and the right side rail 13. The inside bedposts 14A and 17A conceal wiring 31 and 32 and are attached perpendicular to this aforementioned corner joint. The right cable guard 20 also conceals wiring 31 and 32 and is abutted to the corner joint and beneath and parallel to the right side rail 13. Conduit pipe 28 filled with wiring 31 and 32 and originating from the ballast and switch box is fitted into the side of the right cable guard 20.

Figure 3:
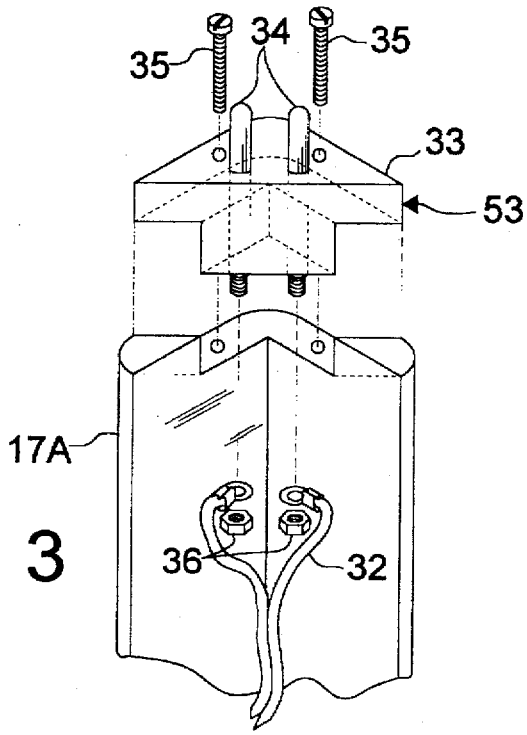
FIG. 3 is a perspective view of the six-foot inside bedpost.

FIG. 3 is a perspective view of the inner workings of the six-foot inside bedpost 17A. The wiring 32 originating from the ballast and switch box runs the length of the inside bedpost 17A and is then attached to two bedpost-top pins 34 by two bedpost top nuts 36. A bedpost-top crest 33 is drilled, and the bedpost-top pins 34 are inserted through the bedpost-top crest 33 which is screwed 35 into the end of the inside bedpost 17A. The bedpost top: crest 33, pins 34, and screws 35 comprise a bedpost-top assembly 53.

Figures 4, 5A:
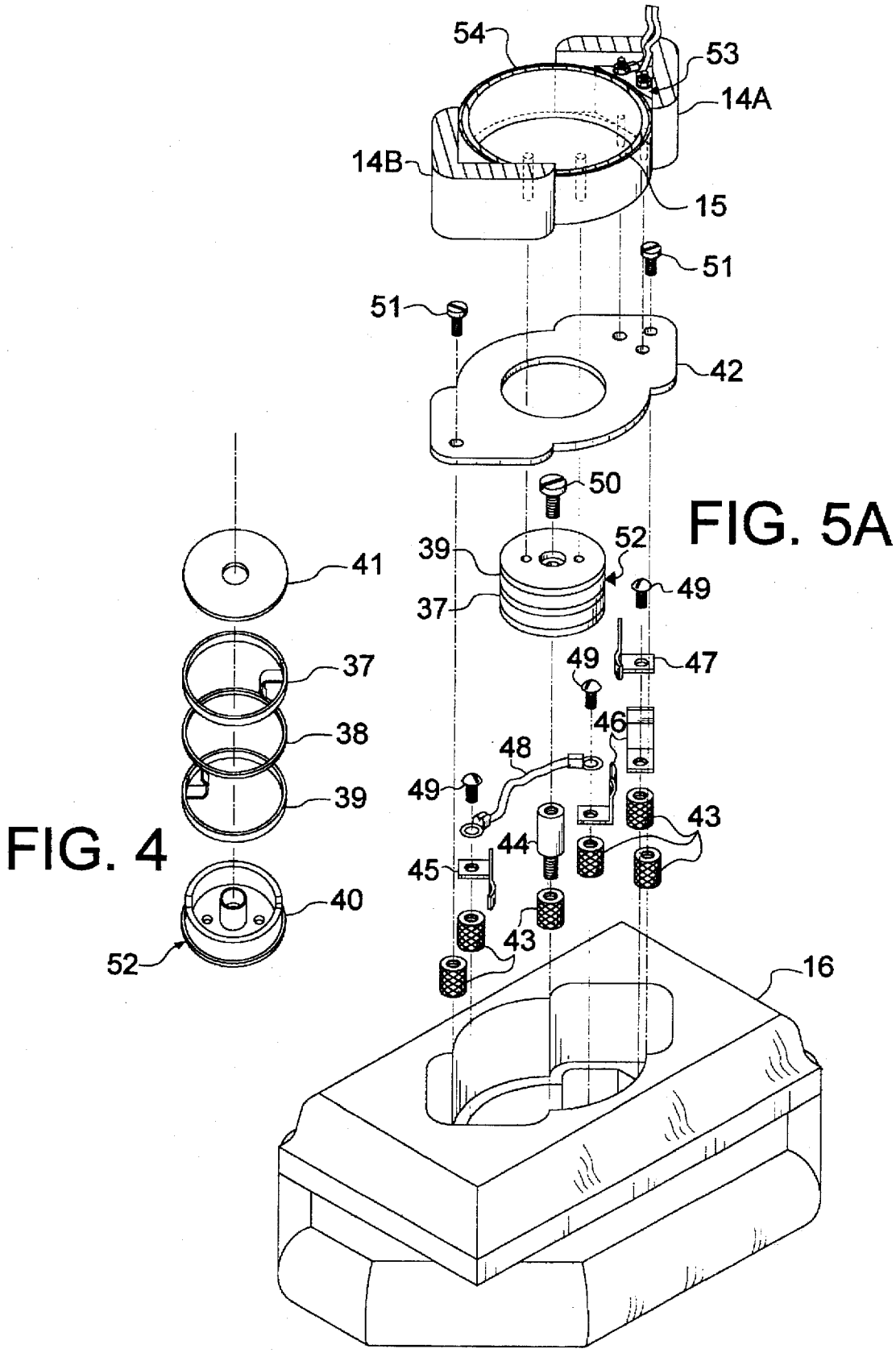
FIG. 4 is an exploded view of an upside-down crown assembly.
FIG. 5A is an exploded view of the four-foot end cap.

FIG. 4 is an exploded view of an upside-down crown assembly 52. The crown assembly 52 is comprised of a lower ring 37, (b) a spacer/insulator 38, (c) an upper ring 39, (d) a hub 40, and (e) a hub cap 41. The upper ring 39 sits atop the spacer/insulator 38 which in turn sits atop the lower ring 37 which in turn sits atop the hub cap 41 all of which are fitted around the hub 40.

FIG. 5A is an exploded view of the essence of our invention, the integration of a fluorescent-light tube 15 into a bedpost 14A and 14B. The fluorescent-light tube 15, encased by the protective plastic sheath 54 and plugged into the crown assembly 52 is sandwiched in between the inside 14A and outside 14B bedpost. The bedpost-top assembly 53 is plugged into an end-cap plate 42 which in turn is screwed 51 into the end cap 16. The end-cap plate 42 centers the crown assembly 52 and covers several knurled screw inserts 43, a lower crown assembly contact 45, two bedpost-top contacts 46, an upper crown assembly contact 47, an end cap wire 48, and several end cap screws 49 all of which are used to attach the bedpost-top assembly 53 through the crown assembly 52 to the fluorescent-light tube 15.

FIG. 5A shows the fine interconnections of the bedpost-top assembly 53 through the crown assembly 52 to the fluorescent-light tube 15. The electrodes of the fluorescent-light tube 15 are plugged into the crown assembly 52 which rotates on an end-cap post 44 and is secured by a crown-assembly screw 50. The end-cap post 44 is in turn screwed into the knurled screw insert 43 which in turn is pressed into the end cap 16. The crown assembly's upper ring 39 is brushed against by the upper crown assembly contact 47. The upper crown assembly contact 47 is attached to the bedpost-top contact 46 and screwed 49 into the knurled screw insert 43 which in turn is pressed into the end cap 16. The bedpost-top contact 46 is brushed against by the pins of the bedpost-top assembly 53. The crown assembly's lower ring 37 is brushed against by the lower crown assembly contact 45. The lower crown assembly contact 45 is wired 48 to the bedpost-top contact 46 and screwed 49 into the knurled screw insert 43 which in turn is pressed into the end cap 16. The bedpost-top contact 46 is brushed against by the pin of the bedpost-top assembly 53.

FIG. 5B is a top view of the end cap 16 that shows the relationship of the upper 47 and lower 45 crown assembly contacts with the crown assembly 52 and the bedpost-top contact 46. The upper crown assembly contact 47 brushes against the crown assembly 52 and the bedpost-top contact 46, whereas the lower crown contact 45 brushes against the crown assembly 52 and is wired 48 to the bedpost-top contact 46. The crown assembly 52 is secured by the crown-assembly screw 50 which in turn is screwed into the knurled screw insert 43 which in turn is pressed into the end cap 16. The upper 47 and lower 45 crown assembly contacts and bedpost-top contact 46 are screwed 49 into knurled screw inserts 43 which in turn are pressed into the end cap 16.

FIG. 6 is a schematic of a ballast and switch box 55 and its inner wiring. The ballast and switch box 55 comprises the four-foot ballast 25 that is wired in parallel to the six-foot ballast 26 that is wired to the power/dimmer switch 30 within the power/dimmer switch box 27. The ballast and switch box 55 has the power cord 29 and the power/dimmer switch 30 running into it and the conduit pipe 28 filled with wiring 31 and 32 running out of it to power and control the fluorescent-light tubes.

From the description above, a number of advantages of our fluorescent-lighted four post bed become evident:

(1) The longevity of the fluorescent lights comprising our bed is 20 times that of the incandescent lights found within previous bed lighting. The average life of our lighting is 20,000 hours (2.25 years continuous) while that of previous bed lighting is about 1000 hours (41 days).

(2) The efficiency of the fluorescent lights comprising our bed is 3.5 times as much light per watt than the incandescent lights found within previous bed lighting.

(3) The location and source of lighting (fluorescent) comprising our bed supplies a nearly shadowless blanket of light for the bed's occupants without the intrusive shadows yielded from the location and source (incandescent) of lights comprising previous beds.

(4) Extra lights are no longer needed in the bedroom because of the brilliant light of the fluorescent light emanating from our invention. Reading lights, table laps, floor lamps all become unnecessary (i.e., not needed to be purchased) with the addition of the fluorescent-lighted four post bed into the bedroom.

(5) An esthetically pleasing bed structure results from the synergistic integration of fluorescent light within the bed posts without ever seeing the unsightly electronic's hardware and light bulbs that can be found in previous bed lighting.

(6) Different moods for the bed's occupants may be created by putting one or multiple color sheaths over the fluorescent-light tubes.

(7) A dimmer switch upon the bed is provided so the amount of illumination can be readily changed.

(8) The provision of a completely novel visual experience: The contrast of light (fluorescent) against dark (bed post) creates a visual illusion caused by the eye recording only the most biologically significant information at any one time. Thus when looking at the bedposts, the eye records only the brightness of the fluorescent light while not recording the darkness of the light guides. One sees only four shafts of light.

(9) The provision of an improved mechanism of the character of bed lighting that which employs rugged and simple construction that may be readily manufactured in many ornamental designs.

(10) A minimum usage of unique parts (~35) which leads to ease and efficiency of manufacturing and marketing which in turn leads to low cost to manufacture with respect to its materials and labor, which accordingly is then susceptible of low prices of sale to the consuming public, thereby making such bed-lighting mechanism economically available to the buying public.

Operation—FIGS. 1A, 1B, and 5B

Basic user operation of the fluorescent-lighted four post bed (FIG. 1B): Basic user operation of the fluorescent-lighted four post bed includes illuminating a room, the bed's occupants, and work and/or pleasure at hand (e.g., reading material). To power on the fluorescent-lighted four post bed, one first pushes the knob of the power/dimmer switch 30 until it clicks. Next, one rotates the knob of the power/dimmer switch 30 until a favorable level of illumination is achieved. To power off the fluorescent-lighted four post bed, one pushes the knob of the power/dimmer switch 30 until it clicks. The power/dimmer 30 switch is conveniently located so that all of these operations can be done with the foot.

Advanced user operation of the fluorescent-lighted four post bed (FIG. 1A): Advanced user operation of the fluorescent-lighted four post bed includes changing the fluorescent-light tubes 15 and 18 and the plastic sheaths 54. A rare event: users may have to replace a burned-out fluorescent-light tube 15 after every 2.25 years of continuous operation. A more common event may be users wanting to change the plastic sheaths 54 encasing the fluorescent-light tubes 15 and 18 to achieve different colors for their illumination.

To remove the fluorescent-light tube 15 and plastic sheath 54, one first pulls off the top end cap 16, which is form fitted to the bedpost 14A and 14B and plugged into the fluorescent-light tube 15. Next, one pulls up on the outside bedpost 14B, which is form fitted to the bottom end cap 16. Next, one pulls up on the fluorescent-light tube 15, which is plugged into the bottom end cap 16. Lastly, one pulls up on the plastic sheath 54 encasing the fluorescent-light tube 15 while holding the fluorescent-light tube 15 still.

To replace the fluorescent-light tube 15 and plastic sheath 54, one first pulls the plastic sheath 54 over the fluorescent-light tube 15 while holding the fluorescent-light tube 15 still. Next, one pushes down on the fluorescent-light tube 15 to plug it into the bottom end cap 16. Next, one pushes down on the outside bedpost 14B to form fit it into the bottom end cap 16. Lastly, one pushes down on the top end cap 16 to form fit it to the bedpost 14A and 14B and plug it into the fluorescent-light tube 15.

Electrical operation of the fluorescent-lighted four post bed (FIGS. 1A, 5A, and 5B). Using the following seven steps, one can see how the fluorescent-light tubes are powered:

1. The electrical power for the fluorescent-lighted four post bed is initiated from the ballast and switch box 22, 23, and 24 which houses a ballast 25 that powers the two, four-foot fluorescent-light tubes 15 and a ballast 26 that powers the two, six-foot fluorescent-light tubes 18.
2. Next, the electrical power pulses through wiring 31 and 32 that is threaded through conduit pipe 28 which is further threaded within side guards 20 and 21 and bedposts 14A, 14B, 17A, and 17B. This wiring ends at the connections to the bedpost-top assembly 53 (FIG. 5A).
3. Next, the electrical power pulses through the fine interconnections within the bedpost 14A and 14B that include the bedpost-top assembly 53, the crown assembly 52, and the fluorescent-light tube 15.
4. Next, the electrical power pulses through the pins of the bedpost-top assembly 53 which make contact with the bedpost-top contact 46.
5. Next, the electrical power pulses through the bedpost-top contact 46 which is attached to the lower 45 or upper 47 crown assembly contact.
6. Next, the electrical power pulses through the lower 45 or upper 47 crown assembly contact which is attached to the crown assembly's lower 37 or upper 39 ring 7. Next, the electrical power pulses through the crown assembly 52 which has the electrodes of the fluorescent-light tube 15 plugged into it.

Thereby, allowing the fluorescent-light tubes 15 and 18 to be illuminated.

SUMMARY, RAMIFICATIONS, AND SCOPE

Accordingly, the reader will see that the fluorescent-lighted four post bed of this invention provides:

a longevity 20 times that of previous bed lighting;

an efficiency rating that is 3.5 times as much that found within previous bed lighting;

a nearly shadowless blanket of light for the bed's occupants without the intrusive shadows yielded from previous bed lighting;

an esthetically pleasing bed structure resulting from the synergistic integration of fluorescent lighting within the bed posts without ever seeing the unsightly electronic's hardware and light bulbs that can be found in previous bed lighting;

a minimum number of unique parts (~35) which leads to low cost of manufacture with respect to its materials and labor, which accordingly is then susceptible of low prices of sale to the consuming public, thereby making such bed-lighting mechanism economically available to the buying public.

In addition, the fluorescent-lighted four post bed has the advantages that:

reading lights, table lamps, floor lamps, etc. all are unnecessary (i.e., not needed to be purchased) with the addition of the fluorescent-lighted four post bed into the bedroom;

different moods for the bed's occupants may be created by putting one or multiple color sheaths over the fluorescent-light tubes;

a dimmer switch upon the bed is provided so the amount of illumination can be readily changed;

it employs rugged and simple construction that may be readily manufactured in many ornamental designs.

Furthermore, the fluorescent-lighted four post bed provides a completely novel visual experience: the contrast of light (fluorescent) against dark (bed post) creates a visual illusion caused by the eye recording only the most biologically significant information at any one time. Thus when looking at the bedposts, the eye records only the brightness of the fluorescent light while not recording the darkness of the light guides. One sees only four shafts of light.

Although the description above contains many specificities, these should not be construed as limiting the scope of the invention but as merely providing illustrations of the presently preferred embodiment. Accordingly, the scope of the invention should be determined not by the embodiment illustrated, but by the appended claims and their legal equivalents.

We claim:

1. A bed, comprising:

fluorescent-light tubes that will serve to radiate illumination within a room and upon occupants of said bed, and plastic sheaths encasing said fluorescent-light tubes that will serve to protect said fluorescent-light tubes, and two elongated, opposing vertical holders of material sandwich said fluorescent-light tubes and said plastic sheaths and will serve as bedposts for said bed and will serve to house wiring for said fluorescent-light tubes, and will enable said fluorescent-light tubes to be exposed for said illumination, and a plurality of milled, flat members of material atop and below said bedposts will serve as end caps to provide ornamental structure to said bedposts and will serve to provide housing for a plurality of electrodes on ends of said fluorescent-light tubes, and two elliptically shaped, flat members of material that will be attached perpendicular to said bedposts will serve as a headboard and a footboard on said bed, and two elongated horizontal, flat members of material that will be attached perpendicular to said headboard and said footboard will serve as side rails on said bed, and two elongated horizontal, flat members of material that will be attached parallel to and underneath said side rails will serve as cable guards on said bed to provide housing for a plurality of wiring for said fluorescent-light tubes and will serve as a basis for a box spring or a mattress, and a power/dimmer switch that will be within a cutout near a back of a bottom of said headboard will serve to brighten and dim said illumination from said fluorescent-light tubes, and ballasts that will be near a front of the bottom of said headboard will serve to power said fluorescent-light tubes, whereby said bedposts topped and bottomed by said endcaps and interconnected by said headboard, footboard, and side rails will protect said fluorescent-light tubes and said plastic sheaths from breakage and provide a harmonized structural means for holding said fluorescent-light tubes that will be powered by said ballasts and controlled by said dimmer switch to shed varying levels of illumination within said room and upon said occupants of said bed.

2. The bed of claim 1 wherein said bedposts, headboard, footboard, side rails, and guard rails are each composed of anodized aluminum, and said end caps are composed of stone.

3. The bed of claim 1 wherein said bedposts, end caps, headboard, footboard, side rails, and guard rails, and are each composed of hardwood.

4. The bed of claim 1 wherein said plastic sheaths are colored.

5. A method for lighting a bed with shadowless illumination, comprising the steps of:

providing fluorescent-light tubes, and providing plastic sheaths encasing said fluorescent-light tubes, and providing elongated vertical holders of material partially encasing said fluorescent-light tubes serving as bedposts, and providing a plurality of flat members of material atop and below said bedposts serving as end caps, and providing two flat members of material attached perpendicular to said bedposts serving as a headboard and a footboard, and providing two elongated horizontal, flat members of material attached perpendicular to said headboard and said footboard serving as side rails, and providing two elongated horizontal, flat members of material attached parallel to said side rails serving as cable guards, and providing a power/dimmer switch within a cutout near a back of a bottom of said headboard, and providing ballasts near a front of the bottom of said headboard, whereby configuration of said fluorescent-light tubes powered by said ballasts and controlled by said power/dimmer switch and sandwiched within said bedposts that are topped and bottomed by said endcaps and interconnected by said headboard, footboard, side rails, and guard rails will radiate bright or dim shadowless illumination upon occupants of said bed or upon the occupants' task at hand.

* * * * *